US007104384B2

(12) United States Patent
Cohrs et al.

(10) Patent No.: US 7,104,384 B2
(45) Date of Patent: Sep. 12, 2006

(54) METHOD AND APPARATUS FOR MEASURING THE DIAMETER OF COINS

(75) Inventors: Ulrich Cohrs, Horneburg (DE); Wilfried Meyer, Buxtehude (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 380 days.

(21) Appl. No.: 10/210,123

(22) Filed: Jul. 31, 2002

(65) Prior Publication Data

US 2003/0034223 A1 Feb. 20, 2003

(30) Foreign Application Priority Data

Aug. 16, 2001 (DE) ..... 101 40 225

(51) Int. Cl.
*G07D 5/08* (2006.01)

(52) U.S. Cl. ..... 194/318; 194/303; 194/320; 194/334

(58) Field of Classification Search ..... 194/303, 194/318, 320, 330; 209/534; 73/163, 514.14; 250/556; 324/222; 382/135, 136; 435/110; 702/38

See application file for complete search history.

(56) References Cited

U.S. PATENT DOCUMENTS 4,998,610 A * 3/1991 Said et al. ..... 194/318
6,173,826 B1 * 1/2001 Furneaux ..... 194/318
6,766,892 B1 * 7/2004 Martin et al. ..... 194/317

FOREIGN PATENT DOCUMENTS

DE 197 26 449 A1 1/1999
WO 89/01209 2/1989

* cited by examiner

*Primary Examiner*—Gene O. Crawford
*Assistant Examiner*—Jeffrey A. Shapiro
(74) *Attorney, Agent, or Firm*—Vidas, Arrett & Steinkraus, P.A.

(57) ABSTRACT

A method for measuring the diameter of coins in coin validators, comprising the steps below:

The coins traverse an electromagnetic field which is formed such as to partially hide the field, at least also by their upper area.

The field is generated between at least one transmitter coil and a receiver coil.

The transmitter coil is periodically acted on by a short transmission pulse the duration of which is small as compared to the time of coin passage.

The maximal attenuation values are determined for different times of the transmission pulse.

The attenuation values measured are extrapolated into time 0.

The measured value determined by extrapolation is compared to a predetermined acceptance band or a predetermined characteristic line for coin diameters for comparison to a stored setting.

10 Claims, 4 Drawing Sheets

Non-linear extrapolation + correction $(I_0 \cdot \beta^{0.017})$

METHOD AND APPARATUS FOR MEASURING THE DIAMETER OF COINS

CROSS-REFERENCE TO RELATED APPLICATION

Not Applicable.

STATEMENT REGARDING FEDERALLY SPONSORED RESEARCH

Not Applicable.

BACKGROUND OF THE INVENTION

If coins are tested in coin validators the inserted coins are tested for various properties to ensure a reliable discrimination of spurious coins. The properties determined for the coins also include their diameters. It is known to measure the diameter of coins by means of two photoelectric light barriers. The diameter thereof is calculated by means of the time the light barriers are covered and the time differential between the light barriers while the coins are passing. This way of size measurement has a measuring tolerance of about ±0.5 mm. However, sets or coins are known in which the individual coins do not differ by more than ±0.5 mm in diameter. There-fore, the known method to exactly identify counterfeit coins is inadequate.

It is further known to conclude on the diameter from the hiding times of inductive coin sensors. This method is not particularly precise either.

DE 197 26 449 has made known a method for testing coins by means of an inductively operating sensor assembly in which the primary coil of the coil assembly is fed by a periodic transmission signal containing harmonics. In the known method, a number of switching steps is associated with the transmission signal. Envelope curves are formed from the value of the reception signal during the respective switching steps repeating at the frequency of the transmission signal. An evaluation device forms at least one criterium from the number of the isochronously produced envelope curves to produce the acceptance or rejection signal. Envelope curves are characteristic of the nature of a coin and can be evaluated in an appropriate manner. Thus, for example, the relationship of the amplitudes of the envelope curves is a characteristic measure.

It is the object of the invention to describe a method for measuring the diameter of coins which makes possible a particularly precise determination.

BRIEF SUMMARY OF THE INVENTION

The coins traverse an electromagnetic field as in the case of common inductive sensors. The coil assembly, however, is formed in such a way that at least the upper area of the coins hides the field at least partially irrespective of their diameter. As in the known method described last, the transmitter coil is fed by a periodic transmission pulse which is short as compared to the time of coin passage. The maximal attenuation values are determined for the different frequencies of the transmission pulse. The frequency of the field will vary, which depends on the time from the beginning of the transmission pulse at which a measurement is made. Maximal values will then be obtained as are also produced in DE 197 26 449 by the envelope curves described there. In the inventive method, these attenuation values measured are extrapolated into time zero and the measured values thus determined are compared to predetermined acceptance bands for coin diameters. If the value determined is not within an acceptance band the coin is ejected as a counterfeit coin.

The inventive method is based on the finding which follows. A coin travelling through a field forms a shielding. However, the extent of the shielding is dependent on the frequency of the field. Low frequencies are mainly attenuated by the material, i.e. the field penetrates through the material, depending on its conductivity. The higher the frequency of the field is, the less it penetrates into the material. The voltage induced on the receiver coil is the more dependent on the hiding effected by the coin, the higher the frequency is. If frequencies are very high a so-called skin effect will arise, i.e. the field practically will nearly stop penetrating into the material of the coin. If an infinitely high frequency was produced the shielding effect would only depend on the size, i.e. the diameter, of the coin. Infinitely high frequency naturally cannot be realized. If the edge of a pulse is infinitely steep the frequency would admittedly become infinite, but this cannot be realized technically. Rather, the transmission circuit needs a certain time to develop the magnetic field, about 1 μs using commercial components.

In the inventive method, the individual frequency-dependent measuring points for the attenuation maxima allow to be linked to form a curve or even a straight line. The shape of the curve is dependent on the proportionality of the attenuation behavior, on one hand, and the configuration of the coil assembly, on the other. Thus, a coil assembly can be imagined in which a linear relationship is obtained between attenuation and diameter.

If the attenuation values measured for the various measuring times of the transmission signal are now extrapolated into time t=0 the attenuation determined hereby forms a measure of the diameter. It has turned out that the measuring technique leads to a very favorable result where the deviations are small. Various methods may be used for an extrapolation of the values measured, e.g. the so-called curve fit, to determine a measuring value each from the measuring values measured, for time zero and, hence, for the diameter of the coin which has passed through. In an aspect of the inventive method, a procedure in the sense of DE 197 26 449 may be adopted, i.e. the transmission pulse may be divided into a number of time steps. A single receiver coil or secondary coil may be provided and the output signals thereof may be formed into envelope curves during switching steps repeating at the respective frequency of the transmission signal. This does not require that the envelope curves be pronouncedly formed, but merely that maximal values be determined for the respective frequencies. Then, the maximal values determined are extrapolated into the time zero in the manner described previously to determine the diameter value.

To implement the inventive method, a suggestion is made according to the invention that rectangular coils should be used as transmitter and receiver coils that are short in the direction of travel of the coin. Preferably, the length of the coins in the direction of travel is distinctly shorter than is the diameter of the smallest coin to be accepted.

According to another aspect of the invention, the receiver coil is divided in height into at least an upper portion and a lower portion where the upper portion is disposed so far above the coin slideway that it is still hidden in part by the coin of the least diameter whereas the lower portion extends up to the coin slideway or ends shortly above it. The upper portion of the receiver coil may be utilized to measure the diameter as this has already been described above. The lower portion serves for material determination with material determination being adapted to be performed in different ways, but also in the manner described in DE 197 26 449.

Finally, according to another aspect of the invention, the lower portion of the receiver coil can be divided into two superposed sub-portions of which the lower sub-portion is hidden by the area of bicoloured coins which is outside the core of the bicoloured coins. As is known bicoloured coins are ones which have a core of a first material and a ring disposed around the core which is of a further material. Some Euro coins are known to be formed as bicoloured coins. Thus, a division of the lower receiver coil portions into two sub-portions allows to carry out a discrimination of the coins in regard of the core and ring of a bicoloured coin.

BRIEF DESCRIPTION OF THE SEVERAL VIEWS OF THE DRAWINGS

The invention will be explained in more detail below with reference to the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
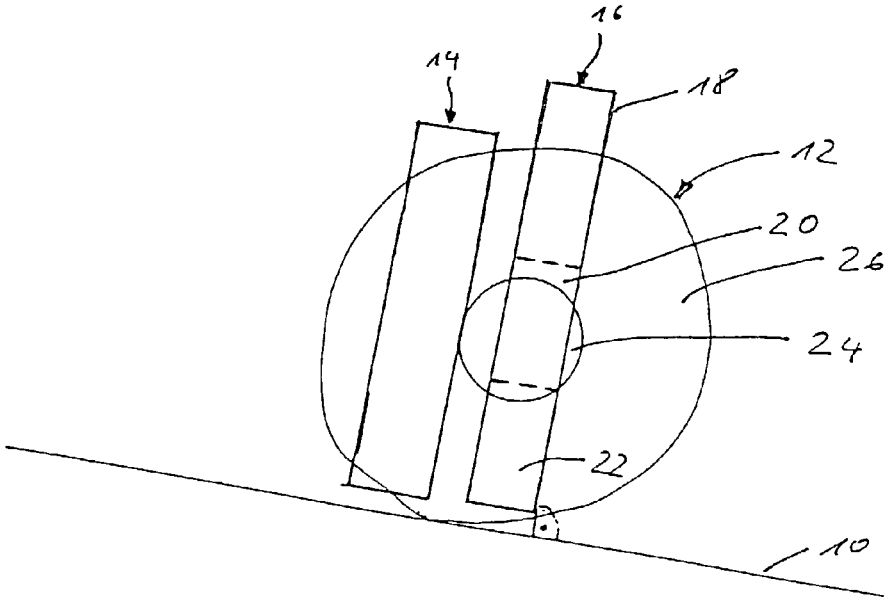
FIG. 1 shows a schematic setup of an apparatus for implementing the method according to the invention.

Referring to FIG. 1, a coin slideway 10 of a coin validator (not shown) can be seen on which a bicoloured coin 12 is rolling along. The coin moves through a coil assembly comprising a transmitter coil 14 and a receiver coil 16. The coil assemblies 14, 16 are rectangular and, in the direction of travel of the coin 12, are shorter than the diameter thereof. Receiver coil 16 is divided into three portions 18, 20, and 22. Such subdivision is made in height. It is such that the portion 18 is anyway hidden in part, at least temporarily, by the upper portion of the coin irrespective of its diameter. The coin 12 consists of an inner core 24 and a ring 26 surrounding the core 24 (bicoloured coin). The upper portion 18 is disposed so as not to be hidden normally by the core 24 while the coil passes through the coil assembly. The portion 20 is designed so as to substantially detect the core region of a bicoloured coin. The lower portion 22 substantially hides the lower region of the border or ring 26. For the measurement yet to be described, it is primarily portion 18 which is resorted to for a diameter determination. Portions 20 and 22 serve for material determination according to a method as is described in DE 197 26 449.

Figure 2:
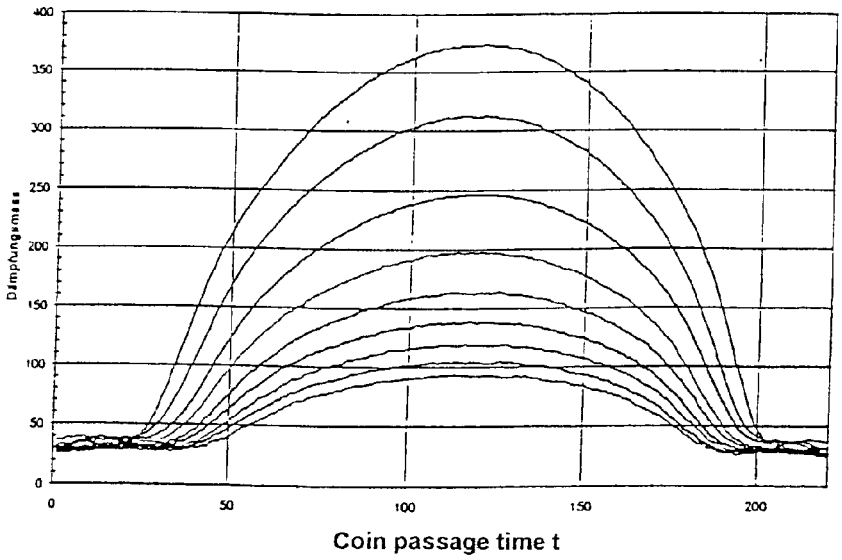
FIG. 2 shows the attenuation characteristic lines for an assembly of FIG. 1, for example, during the passage of coins made of a different material.

The transmitter coil 14 is periodically applied to by rectangular pulses the duration of which is 30 μs, for example. Since it takes a coin about 200 ms to pass through a coil assembly as is shown in FIG. 1 the duration of the transmission signal is small as compared to the time of coin passage. Such a rectangular pulse is recurringly employed also in the method of DE 197 26 449 which was mentioned already. According to this document, if the transmission pulse is divided into individual time periods or switching steps and if a measurement of the signal of the receiver coil 18 is made at the individual time steps one of the curves shown in FIG. 2 is obtained. The curve which has the highest maximum is one that corresponds to a maximal attenuation. A maximal attenuation or shielding is obtained when the frequency is maximal. Therefore, this curve corresponds to the highest frequency at which measurements are made, i.e. during a switching step which is behind the start of the transmission pulse. If measurements are recurringly made always during this time during the coin passage time the aforementioned curve is obtained at the maximal maximum. If the time steps are farther away from the point of start or the leading edge of the rectangular pulse the consequence is a smaller frequency and, hence, a lower attenuation. In other words, a varying attenuation which depends on frequency is obtained for one and the same coin material during the passage of the coin. As was mentioned the varying frequency results from the time of measurement relative to the leading edge of the rectangular pulse.

Incidentally, note that the array of curves of FIG. 2 cannot be achieved by a bicoloured coin, but this one yields another array of curves as is appropriately depicted in the aforementioned DE 197 26 449. On the contrary, the array of curves of FIG. 2 refers to a coin which is homogeneously manufactured from a certain material.

Figure 5:
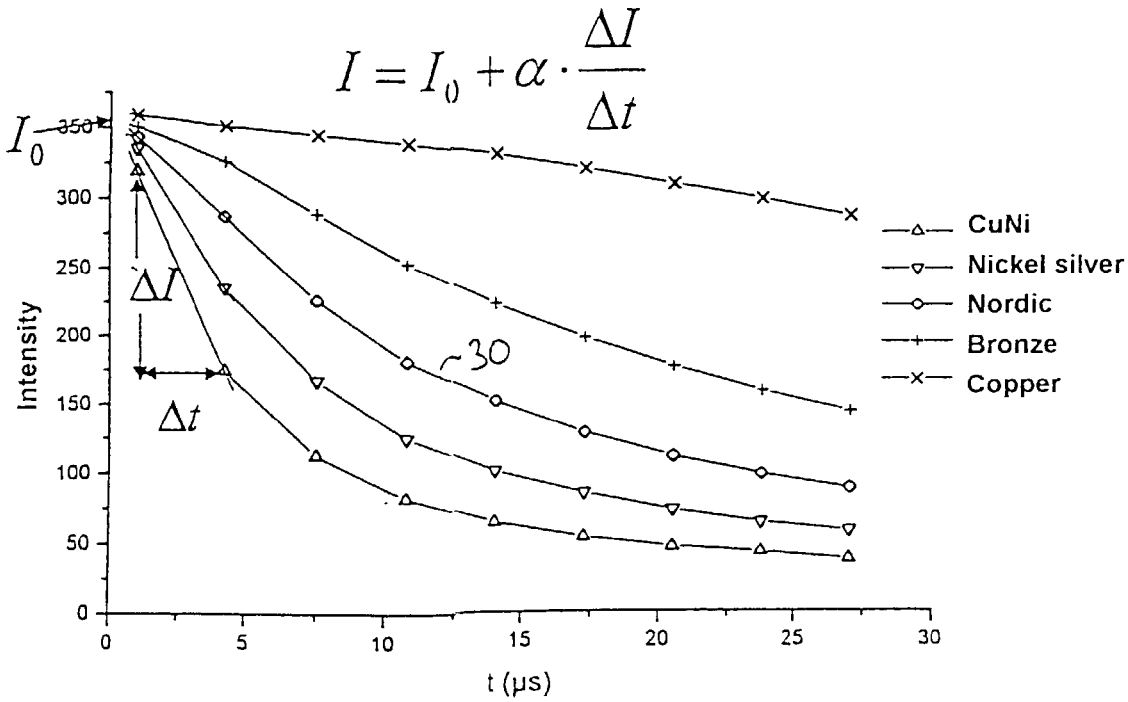
FIG. 5 shows a characteristic line field similar to that of FIG. 3, but where a correction was made to the linear extrapolation.

Now, if the maxima of the array of curves of FIG. 2 are linked to form a curve the curve march 30 of FIG. 5 will result, for example. The individual measuring points on curve 30 correspond to varying frequencies, the consequence of which will thus be a varying attenuation. If a different material is used different curve marchs will arise as is shown in FIG. 5. The legend on the right of FIG. 5 reveals how to associate the curves with materials.

It requires a certain time, e.g. 1 μs, to set up the rectangular voltage or rectangular pulse as a transmission signal. However, since efforts are made to exclude the material-dependent attenuation value and, thus, to satisfy the assumption that the frequency is infinitely high it needs extrapolating the curves of FIG. 5 to obtain the attenuation value at the time 0. This is outlined in FIG. 5 in which the curves of FIG. 3 are substantially represented.

Figure 3:
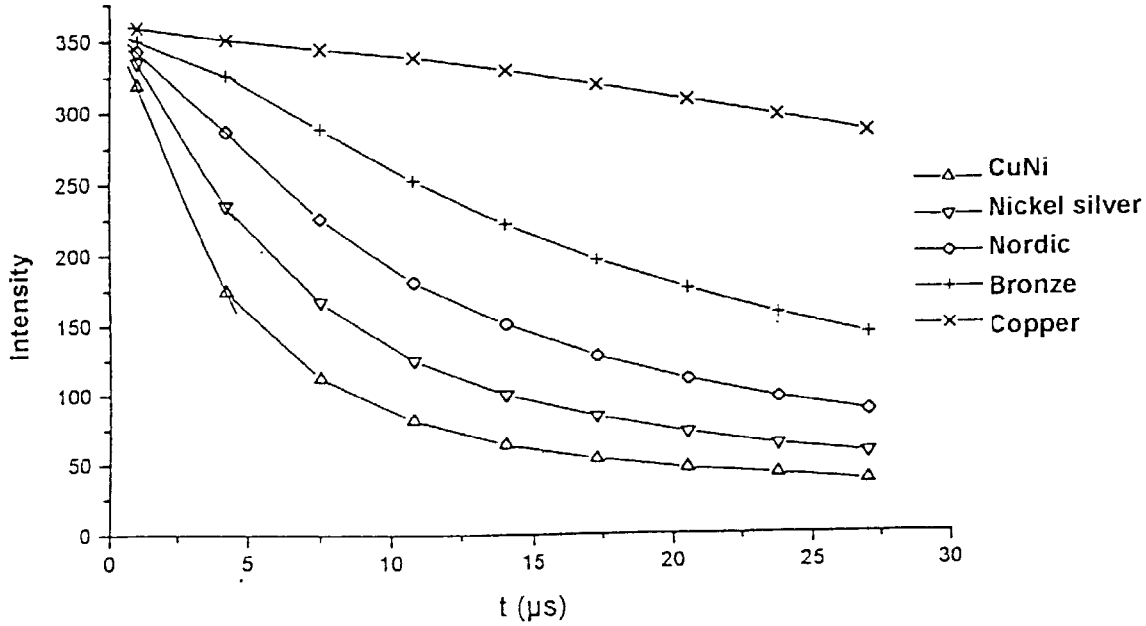
FIG. 3 shows a characteristic line field of maximal values of attenuation for different materials including their extrapolation into 0.
Figure 4:
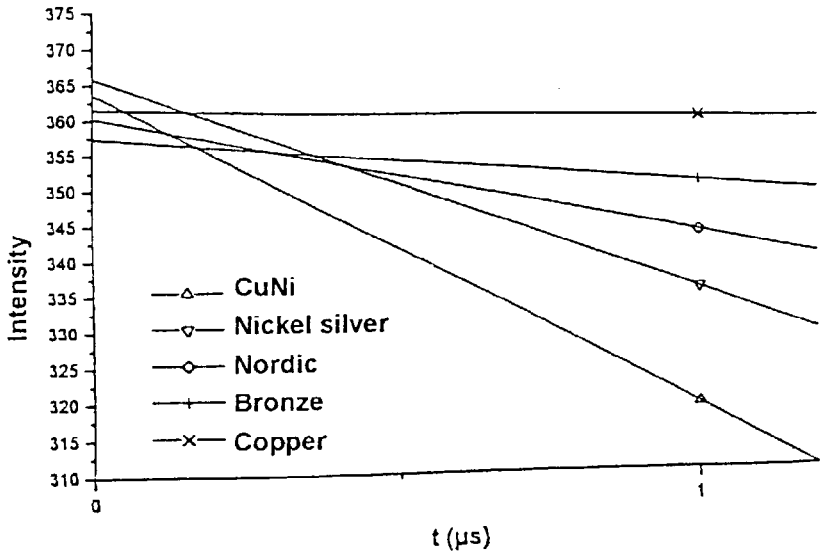
FIG. 4 Shows an enlarged detail of FIG. 4 with an extrapolation into 0.

FIG. 4 plots the march of the curves of FIG. 3 within a time limit of 0 to 1 μs. It can be seen that the range of attenuation fluctuates between 367 and 357.5 for individual materials for the same diameter of a coin. This is an exceptionally small range which is sufficient to determine the diameter size in an adequately precise manner.

Figure 6:
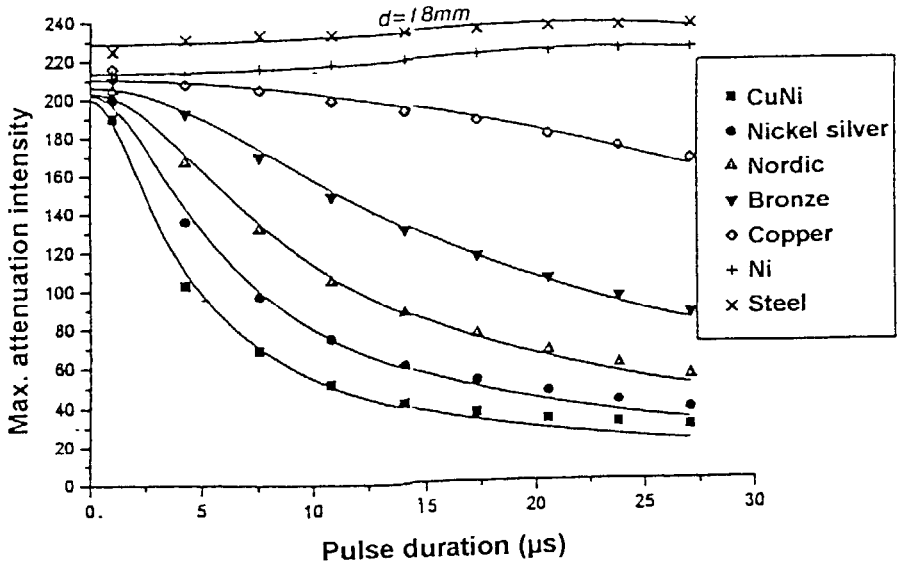
FIG. 6 shows a characteristic line field similar to that of FIG. 3, but where the extrapolation is non-linear.

In FIG. 6, a non-linear extrapolation was made as is also known as such, e.g. by the "Curve fit" designation. Whilst the curves of FIGS. 3 to 5 use a diameter value of 30 mms the array of curves of FIG. 6 is based on a coin diameter of 18 mms.

Figure 7:
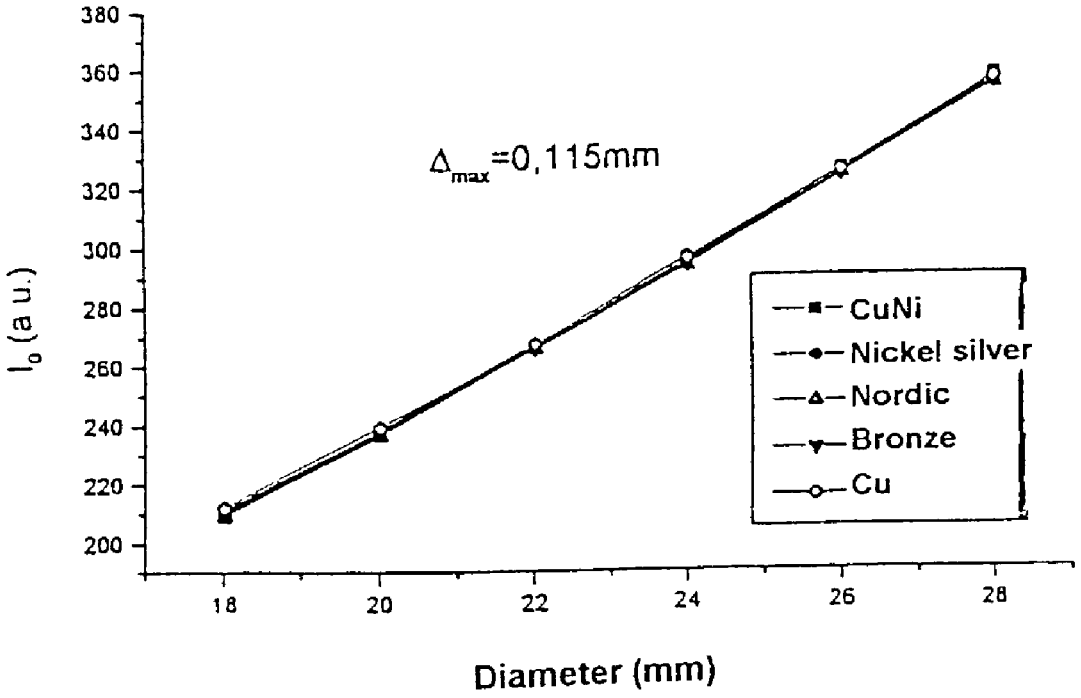
FIG. 7 shows a characteristic line for different diameters and materials where the extrapolation is non-linear and a correction was made.

In FIG. 7, the characteristic line of the diameter is plotted via the attenuation values measured for a non-linear extrapolation and correction of the array of curves of FIG. 3 and FIG. 5, respectively. It can be seen that the measuring points of different materials are located approximately on a function approximating to a straight line so that the described method allows to exactly establish whether or not a coin which is inserted is within a predetermined range of diameters. The diameters required for individual coins of a set of coins can be defined through a diameter window that needs to be very small so as to enable an exact discrimination for sets of coins even of very small differences in diameter. The maximal error is about 0.115 mm, at least theoretically. This error is sufficient to differentiate even between those coins which vary only by 0.5 mm in diameter.

As was mentioned already the method described may be implemented by means of the receiver coil 18 alone. Receiver coil portions 20 and 22 may be resorted to for a material determination in a manner as is described in DE 197 26 449. In this case, the envelope curves of FIG. 2 which are also produced in those portions serve for material determination. Coins which are configured as bicoloured coins may also be detected according to the known method.

The above Examples and disclosures are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A method for measuring the diameter of coins in coin validators, comprising:

arranging a coin to traverse an electromagnetic field such that the field is at least partially attenuated, also by an upper rim of the coin;

the field being generated between at least one transmitter coil and a receiver coil;

the transmitter coil periodically providing a short transmission pulse containing a plurality of harmonics, the duration of the pulse being small as compared to the time of coin passage;

measuring the maximum attenuation values received by the receiver coil for different time portions of the repeating transmission pulses;

forming a time curve (having intensity =f(t)) from the maximum attenuation values extrapolating the time curve to determine a projected curve value at the initiation of the transmission pulse defining the attenuation value at the time $\sigma$;

comparing the projected curve value determined by extrapolation to a predetermined acceptance band or a predetermined characteristic line for coin diameters for comparison to a stored setting.

2. The method as claimed in claim 1, characterized in that envelope curves are formed from the measured values received by the receiver coil during the respective time portions repeating at the frequency of the transmission pulse, and an evaluation device determines the respective maxima from each of the isochronously produced envelope curves.

3. The method of claim 1 further comprising: proving a coil assembly having rectangular coils, the rectangular coils defining at least some of the transmitter and receiver coils, wherein the dimension of each rectangular coil in the direction of travel of the coin is less than the diameter of the smallest coin to be accepted.

4. The method of claim 3, wherein the receiver coil is divided in height into an upper portion and a lower portion; where the upper portion is disposed above a coin slideway such that it is only partially covered by a coin of the least diameter to be accepted.

5. The method of claim 4, wherein the lower portion is divided into two superposed sub-portions, of which the lower sub-portion hides an area ofabicoloured coin which is outside the core of the bicoloured coin.

6. The method of claim 4, wherein the lower portion extends up to the coin slideway.

7. The method of claim 4, wherein the lower portion extends shortly above the coin slideway.

8. The method of claim 1, wherein each transmission pulse includes a plurality of time portions, the attenuation values received by the receiver coil being measured during each time portion.

9. A method of measuring the diameter of a coin comprising:

providing a coin to be measured;

generating a field comprising a plurality of electromagnetic pulses between a transmitter coil and a receiver coil;

moving the coin through the field;

measuring the maximum attenuation values of the electromagnetic pulses received by the receiver coil at predetermined time intervals during each electromagnetic pulse as the coin moves through the field;

extrapolating the measured maximum attenuation values to determine a projected attenuation value at the initiation of an electromagnetic pulse;

comparing the projected attenuation value to a predetermined range of values to determine the diameter of the coin.

10. The method of claim 9, wherein each electromagnetic pulse comprises a plurality of predetermined time intervals, the electromagnetic signal generated during each predetermined time interval having a different frequency spectrum.

* * * * *